US008665254B2

(12) United States Patent
Chung et al.

(10) Patent No.: US 8,665,254 B2
(45) Date of Patent: Mar. 4, 2014

(54) PIXEL CIRCUIT OF DISPLAY PANEL, METHOD OF CONTROLLING THE PIXEL CIRCUIT, AND ORGANIC LIGHT EMITTING DISPLAY INCLUDING THE DISPLAY PANEL

(75) Inventors: Bo-Yong Chung, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1031 days.

(21) Appl. No.: 12/719,587

(22) Filed: Mar. 8, 2010

(65) Prior Publication Data

US 2011/0063266 A1 Mar. 17, 2011

(30) Foreign Application Priority Data

Sep. 16, 2009 (KR) ..... 10-2009-0087636

(51) Int. Cl.
*G09G 5/00* (2006.01)

(52) U.S. Cl.
USPC ..... 345/205; 345/80; 345/82

(58) Field of Classification Search
USPC ..... 345/204, 205, 206, 690, 76, 77, 78, 80, 345/82; 250/552, 553; 315/169.3; 313/463, 313/498
See application file for complete search history.

(56) References Cited

U.S. PATENT DOCUMENTS 6,911,781 B2 * 6/2005 Yamazaki et al. ..... 315/169.3
7,561,128 B2 * 7/2009 Ahn et al. ..... 345/82
7,629,951 B2 12/2009 Wu
8,243,055 B2 * 8/2012 Abe ..... 345/211
2005/0088378 A1 * 4/2005 Ozawa et al. ..... 345/76
2005/0156831 A1 * 7/2005 Yamazaki et al. ..... 345/76
2005/0280614 A1 12/2005 Goh
2006/0170628 A1 8/2006 Yamashita et al.
2006/0253755 A1 11/2006 Wu
2007/0210994 A1 9/2007 Chen et al.
2008/0111804 A1 5/2008 Choi et al.
2008/0211397 A1 9/2008 Choi
2008/0224621 A1 9/2008 Uchino et al.
2008/0224965 A1 9/2008 Kim
2008/0225061 A1 9/2008 Kimura et al.
2008/0231199 A1 * 9/2008 Yamamoto et al. ..... 315/169.3
2008/0252573 A1 10/2008 Fish et al.
2008/0309595 A1 * 12/2008 Nitomi et al. ..... 345/76

(Continued)

FOREIGN PATENT DOCUMENTS

KR 10-2005-073950 7/2005
KR 10-2005-0121379 A 12/2005

(Continued)

OTHER PUBLICATIONS

KIPO Registration Certificate dated Jul. 28, 2011 for KR 10-2009-0087636 (5 pages).

(Continued)

*Primary Examiner* — Tom Sheng
(74) *Attorney, Agent, or Firm* — Christie, Parker & Hale, LLP

(57) ABSTRACT

A pixel circuit of a display panel, a method of driving the pixel circuit, and an organic light emitting display device including the display panel. All of a plurality of transistors included in the pixel circuit are NMOS transistors, and the pixel circuit configured to compensate for a voltage change at a source electrode of a driving transistor during light emission.

20 Claims, 3 Drawing Sheets

(56) References Cited

U.S. PATENT DOCUMENTS

| | | | | |
|---|---|---|---|---|
| 2009/0251443 | A1 | 10/2009 | Jinta | |
| 2010/0001983 | A1* | 1/2010 | Abe | 345/211 |
| 2010/0271363 | A1 | 10/2010 | Chung | |
| 2011/0069058 | A1* | 3/2011 | Chung et al. | 345/212 |

FOREIGN PATENT DOCUMENTS

| | | | |
|---|---|---|---|
| KR | 10-2008-0084017 | A | 9/2008 |
| KR | 10-2008-0084603 | | 9/2008 |
| KR | 10-2009-0016333 | A | 2/2009 |

OTHER PUBLICATIONS

KIPO Patent Determination Certificate dated Jul. 28, 2011, for Korean Patent application 10-2009-0089646, (5 pages).

U.S. Office action dated Aug. 14, 2012, for cross reference U.S. Appl. No. 12/730,854, (31 pages).

U.S. Office action dated Jan. 18, 2013, for cross reference U.S. Appl. No. 12/730,854, (29 pages).

English machine translation of Korean Publication 102005073950 listed above, (13 pages), 2005.

* cited by examiner

PIXEL CIRCUIT OF DISPLAY PANEL, METHOD OF CONTROLLING THE PIXEL CIRCUIT, AND ORGANIC LIGHT EMITTING DISPLAY INCLUDING THE DISPLAY PANEL

CROSS-REFERENCE TO RELATED PATENT APPLICATION

This application claims priority to and the benefit of Korean Patent Application No. 10-2009-0087636, filed on Sep. 16, 2009, in the Korean Intellectual Property Office, the disclosure of which is incorporated herein in its entirety by reference.

BACKGROUND

1. Field

An aspect of an embodiment of the present invention relates to a pixel circuit of a display panel, a method of driving the pixel circuit, and an organic light emitting display device including the display panel.

2. Description of the Related Art

Display devices receive image data from an external source and display images corresponding to the image data. Examples of the display devices include cathode ray tubes (CRTs), field emission displays (FEDs), liquid crystal displays (LCDs), and plasma display panel (PDPs).

Organic light emitting display devices using organic light emitting diodes (OLEDs) as organic light emitting devices have been developed of late and are being used in some products. In such organic light emitting display devices, a display panel includes a plurality of pixel circuits, and images may be displayed on the display panel by controlling the light emission of an OLED included in each of the pixel circuits. The pixel circuits included in the display panel affect the quality of display of the organic light emitting display devices. Much research into the structure of pixel circuits and driving methods thereof are currently being conducted.

SUMMARY

An aspect of an embodiment of the present invention provides a pixel circuit of a display panel, capable of compensating for a voltage change at a source electrode of a driving transistor during light emission, a method of driving the pixel circuit, and an organic light emitting display device including the display panel.

According to an embodiment of the present invention, there is provided a pixel circuit for a display panel, including: an organic light emitting diode (OLED) including an anode and a cathode; a first NMOS transistor including a first electrode coupled to a first node, a second electrode coupled to the anode of the OLED, and a gate electrode coupled to a second node; a second NMOS transistor including a first electrode coupled to the second node, a second electrode coupled to the first node, and a gate electrode; a third NMOS transistor including a first electrode coupled to a first power source, a second electrode coupled to the first node, and a gate electrode; a fourth NMOS transistor including a first electrode coupled to a data line, a second electrode coupled to a third node, and a gate electrode; a fifth NMOS transistor including a first electrode coupled to a reference power source, a second electrode coupled to the third node, and a gate electrode; a sixth NMOS transistor including a first electrode, a second electrode coupled to the anode of the OLED, and a gate electrode; a seventh NMOS transistor including a first electrode, a second electrode coupled to the first electrode of the sixth NMOS transistor, and a gate electrode; a first capacitor coupled between the second node and the third node; a second capacitor coupled between the third node and the anode of the OLED; and a third capacitor coupled between the second node and the first electrode of the sixth NMOS transistor.

A previous scan signal may be applied to the gate electrode of the second NMOS transistor and the gate electrode of the seventh NMOS transistor.

A current scan signal may be applied to the gate electrode of the sixth NMOS transistor and the first electrode of the seventh NMOS transistor.

An emission signal or a clock signal may be applied to the gate electrode of the third NMOS transistor.

A current scan signal may be applied to the gate electrode of the fourth NMOS transistor and a previous scan signal may be applied to the gate electrode of the fifth NMOS transistor. The reference power source may output a ground voltage.

A previous scan signal may be applied to the gate electrode of the fourth NMOS transistor and a current scan signal is applied to the gate electrode of the fifth NMOS transistor. The reference power source may output a high level signal.

The first electrode of the first NMOS transistor may be a drain electrode and the second electrode of the first NMOS transistor may be a source electrode.

The capacitances of the first and second capacitors may be greater than the capacitance of the third capacitor.

According to another embodiment of the present invention, there is provided a method of driving a pixel circuit including an OLED, the OLED including an anode and a cathode, a driving transistor, a plurality of switching transistors, a booster transistor including a first electrode, a second electrode coupled to the anode of the OLED, and a gate electrode, a plurality of capacitors, and a booster capacitor coupled between the gate electrode of the driving transistor and the first electrode of the booster transistor, wherein the driving transistor, the plurality of switching transistors, and the booster transistor are NMOS transistors, the method including applying a previous scan signal, an emission signal, and a current scan signal to the pixel circuit. When the previous scan signal and the emission signal are logic low and the current scan signal is logic high, the booster transistor is turned on, and a voltage change at the first electrode of the booster transistor is transmitted to the gate electrode of the driving transistor due to coupling of the booster capacitor.

The voltage change at the first electrode of the booster transistor may be a change from a voltage at the first electrode of the booster transistor when the current scan signal is logic low to a threshold voltage of the OLED.

When the previous scan signal is logic high and the current scan signal and the emission signal are logic low, the driving transistor may be diode-connected to compensate for the threshold voltage of the OLED.

When the previous scan signal and the current scan signal are logic low and the emission signal is logic high, a voltage change at the anode of the OLED may be transmitted to the gate electrode of the driving transistor due to coupling of the plurality of capacitors.

According to another embodiment of the present invention, there is provided an organic light emitting display device including a scan driver for providing scan signals to a plurality of scan lines; an emission driver for providing emission signals to a plurality of emission control lines; a data driver for providing data signals to a plurality of data lines; and a plurality of pixel circuits located at crossing regions of the scan lines, the emission control lines, and the data lines, wherein each of the pixel circuits includes an organic light emitting diode (OLED) including an anode and a cathode; a first NMOS transistor including a first electrode coupled to a first node, a second electrode coupled to the anode of the OLED, and a gate electrode coupled to a second node; a second NMOS transistor including a first electrode coupled to the second node, a second electrode coupled to the first node, and a gate electrode; a third NMOS transistor including a first electrode coupled to a first power source, a second electrode coupled to the first node, and a gate electrode; a fourth NMOS transistor including a first electrode coupled to a data line, a second electrode coupled to a third node, and a gate electrode; a fifth NMOS transistor including a first electrode coupled to a reference power source, a second electrode coupled to the third node, and a gate electrode; a sixth NMOS transistor including a first electrode, a second electrode coupled to the anode of the OLED, and a gate electrode; a seventh NMOS transistor including a first electrode, a second electrode coupled to the first electrode of the sixth NMOS transistor, and a gate electrode; a first capacitor coupled between the second node and the third node; a second capacitor coupled between the third node and the anode of the OLED; and a third capacitor coupled between the second node and the first electrode of the sixth NMOS transistor.

The gate electrode of the second NMOS transistor, the gate electrode of the fifth NMOS transistor, and the gate electrode of the seventh NMOS transistor may be coupled to an (N−1)th scan line, wherein N is a natural number satisfying 0<N<n. The gate electrode of the third NMOS transistor may be coupled to an N-th emission control line. The gate electrode of the fourth NMOS transistor, the gate electrode of the sixth NMOS transistor, and the first electrode of the seventh NMOS transistor may be coupled to the N-th scan line.

The gate electrode of the second NMOS transistor, the gate electrode of the fourth NMOS transistor, and the gate electrode of the seventh NMOS transistor may be coupled to an (N−1)th scan line, wherein N is a natural number satisfying 0<N<n. The gate electrode of the third NMOS transistor may be coupled to an N-th emission control line. The gate electrode of the fifth NMOS transistor, the gate electrode of the sixth NMOS transistor, and the first electrode of the seventh NMOS transistor may be coupled to an N-th scan line.

The first electrode of the first NMOS transistor may be a drain electrode and the second electrode of the first NMOS transistor may be a source electrode.

The capacitances of the first and second capacitors may be greater than the capacitance of the third capacitor.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Hereinafter, the present invention will be described in detail by explaining various embodiments of the invention with reference to FIGS. 1 through 5.

Figure 1:
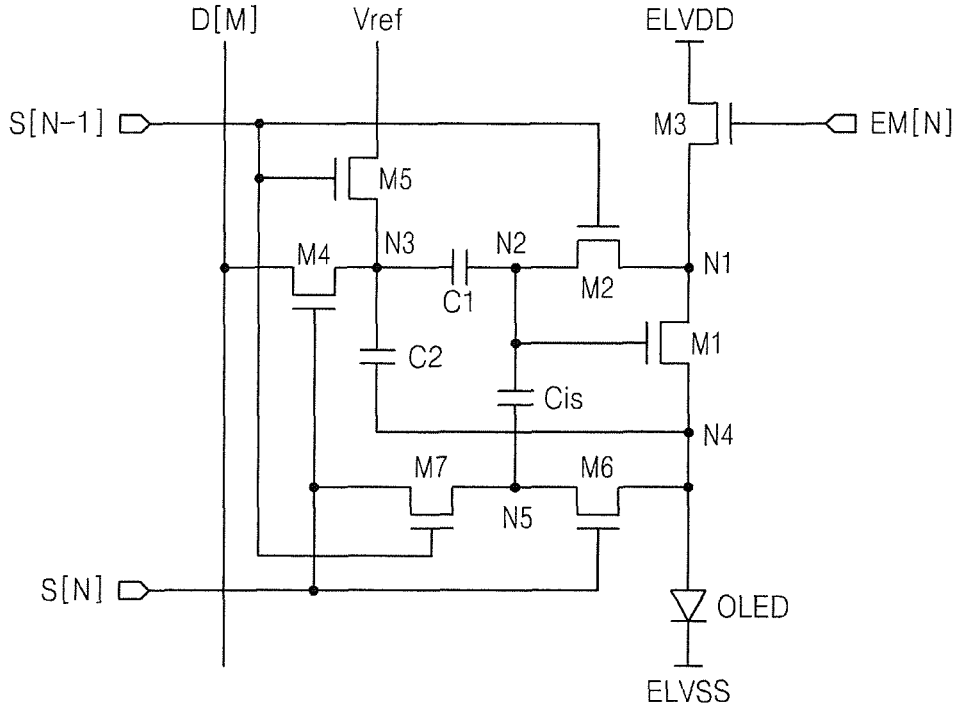
FIG. 1 is a circuit diagram of a pixel circuit of a display panel, according to an embodiment of the present invention.

FIG. 1 is a circuit diagram of a pixel circuit of a display panel, according to an embodiment of the present invention.

Referring to FIG. 1, the pixel circuit according to the present embodiment may include an organic light emitting diode (OLED), a driving transistor, which is a first transistor M1, a plurality of switching transistors, which are second through seventh transistors M2 through M7, and a plurality of capacitors, which are first through third capacitors C1, C2 and Cis. In one embodiment, all of the transistors included in the pixel circuit are NMOS transistors. In the display panel, a plurality of the pixel circuits may be arranged in an n×m matrix. The pixel circuit illustrated in FIG. 1 corresponds to a pixel circuit located in an N-th row and an M-th column.

The OLED includes an anode and a cathode, wherein the cathode is connected to a second power source. The OLED generates light when it is driven by a current generated by the driving transistor. The brightness of the light depends on the magnitude of the current flowing through the OLED.

Referring to FIG. 1, the first transistor M1 includes a first electrode connected to a first node N1, a second electrode connected to the anode of the OLED, and a gate electrode connected to a second node N2. The first electrode of the first transistor M1 may be a drain electrode, and the second electrode of the first transistor may be a source electrode. The first transistor M1 operates as the driving transistor, and it generates a current corresponding to a voltage Vgs between the gate electrode and the source electrode and outputs the current to the OLED. Hereinafter, the terms "first transistor" and "driving transistor" will be used interchangeably.

The second transistor M2 includes a first electrode connected to the second node N2 and a second electrode connected to the first node N1. The second transistor M2 also includes a gate electrode to which an external control signal is applied. The second transistor M2 is connected between the first electrode and the gate electrode of the driving transistor M1, and when the second transistor M2 is turned on by the external control signal, the second transistor M2 configures the driving transistor M1 into a diode-connected state. The diode-connected driving transistor M1 may compensate for a threshold voltage Vth of the driving transistor M1 and a threshold voltage Vto of the OLED, which is present between the anode and the cathode of the OLED during non-emission. The external control signal corresponds to a previous scan signal provided from a previous scan line, which is an (N−1) th scan line S[N−1] in FIG. 1. Thus, the gate electrode of the second transistor M2 is connected to the previous scan line S[N−1].

The third transistor M3 includes a first electrode connected to a first power source and a second electrode connected to the first node N1. The third transistor M3 also includes a gate electrode to which an external control signal is applied. When the third transistor M3 is turned on according to the external control signal, the third transistor M3 applies a first power supply voltage ELVDD to the first electrode of the driving transistor M1. Since the third transistor M3 is turned on, a current is generated by the driving transistor M1, and the current flows to the OLED. The external control signal is an emission signal and is provided from an N-th emission control line EM[N]. Thus, the gate electrode of the third transistor M3 is connected to the N-th emission control line EM[N].

The fourth transistor M4 includes a first electrode connected to an M-th data line D[M] and a second electrode connected to a third node N3. The fourth transistor M4 also includes a gate electrode to which an external control signal is applied. When the fourth transistor M4 is turned on according to the external control signal, a data voltage Vdata provided from the M-th data line D[M] is applied to the third node N3. That is, data writing is performed. The external control signal is a current scan signal provided from an N-th scan line S[N], which is a current scan line. Thus, the gate electrode of the fourth transistor M4 is connected to the current scan line S[N].

The fifth transistor M5 includes a first electrode connected to a reference power source and a second electrode connected to the third node N3. The fifth transistor M5 also includes a gate electrode to which an external control signal is applied. When the fifth transistor M5 is turned on according to the external control signal, a reference voltage Vref provided from the reference power source is applied to the third node N3. The external control signal may be the previous scan signal which is applied to the gate electrode of the second transistor M2. Thus, the gate electrode of the fifth transistor M5 is connected to the previous scan line S[N−1].

The sixth transistor M6 includes a first electrode connected to the third capacitor Cis and a second electrode connected to the anode of the OLED. The sixth transistor M6 also includes a gate electrode to which an external control signal is applied. When the sixth transistor M6 is turned on according to the external control signal, a voltage of the anode of the OLED is applied to one terminal of the third capacitor Cis. The external control signal may be the scan signal which is applied to the gate electrode of the fourth transistor M4. Thus, the gate electrode of the sixth transistor M6 is connected to the current scan line S[N].

The seventh transistor M7 includes a first electrode connected to the current scan line S[N] and a second electrode connected to the first electrode of the sixth transistor M6. The seventh transistor M7 also includes a gate electrode to which an external control signal is applied. When the seventh transistor M7 is turned on by the external control signal, the current scan signal is applied to a fifth node N5. The external control signal may be the previous scan signal which is applied to the gate electrode of the second transistor M2. Accordingly, the gate electrode of the seventh transistor M7 is connected to the previous scan line S[N−1].

The second through seventh transistors M2 through M7 serve as the switching transistors.

The first capacitor C1 includes a first terminal connected to the third node N3 and a second terminal connected to the second node N2.

The second capacitor C2 includes a first terminal connected to the third node N3 and a second terminal connected to the anode of the OLED.

The third capacitor Cis includes a first terminal connected to the second node N2 and a second terminal connected to the first electrode of the sixth transistor M6, which is coupled to the fifth node N5. When the sixth transistor M6 is turned on according to the current scan signal, the voltage of the anode of the OLED is applied to the second terminal of the third capacitor Cis. Due to the coupling (e.g., capacitive coupling) of capacitors, a voltage change generated at the second terminal of the third capacitor Cis couples a corresponding voltage change at the first terminal of the third capacitor Cis, which is coupled to the gate electrode of the driving transistor M1.

When a capacitance of the first capacitor C1 is c1, a capacitance of the second capacitor C2 is c2, and a capacitance of the third capacitor Cis is cis, a condition of c1>>cis, c2>>cis is satisfied.

The first power source provides the first power supply voltage ELVDD, and the second power source provides a second power supply voltage ELVSS. The second power supply voltage ELVSS may be a ground voltage GND. The reference power source may provide a reference voltage Vref, which may be a ground voltage GND.

As described above, all of the transistors included in the pixel circuit according to one embodiment may be NMOS transistors. In a conventional pixel circuit, PMOS transistors may be used. Since crystalline silicon is used to manufacture PMOS-type thin film transistors (TFTs), an Excimer Laser Annealing (ELA) device, which is a crystallization device, is used.

However, when a pixel circuit uses NMOS transistors, the following considerations exist.

First, a TFT may be manufactured using amorphous silicon (a-Si), and thus an ELA device, which is expensive, is not used.

Second, the number of masks used may be reduced when a pixel circuit using NMOS transistors is produced, compared with when a pixel circuit using PMOS transistors is produced.

Third, when NMOS transistors are used, it is possible to use oxide TFTs. When oxide TFTs are used, voltage uniformity, which is an advantage of amorphous silicon, and a high electron mobility, which is an advantage of Low-Temperature Poly-Silicon (LTPS), can be achieved. This facilitates an improvement of the life span of a display panel and realization of a high resolution.

In the case of LCDs, pixel circuits are manufactured by using only NMOS transistors. Thus, equipment for manufacturing LCDs may be used in manufacturing the pixel circuit according to the above described embodiment, resulting in cost savings.

An operation of the pixel circuit of FIG. 1 will now be described with reference to FIG. 2.

Figure 2:
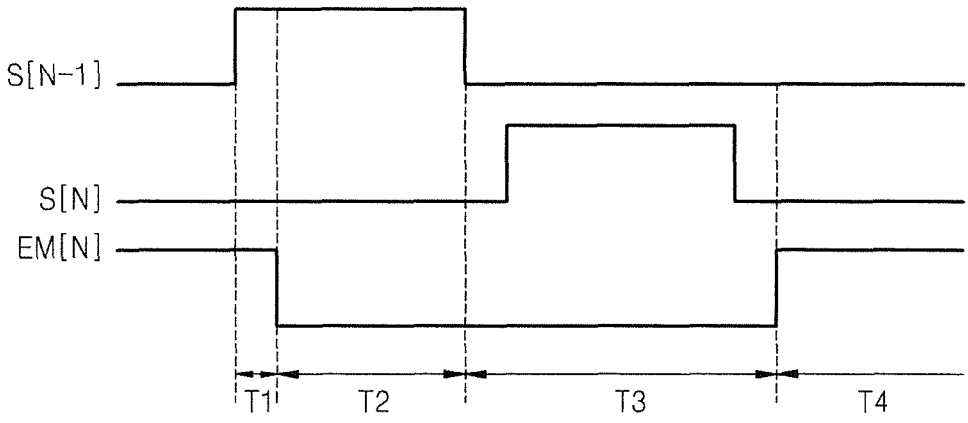
FIG. 2 is a timing diagram for describing a method of driving the pixel circuit illustrated in FIG. 1.

FIG. 2 is a timing diagram for describing a method of driving the pixel circuit illustrated in FIG. 1.

Overall operation of the pixel circuit is divided into four intervals including first through fourth intervals T1 through T4. An operation of the pixel circuit in each of the first through fourth intervals T1 through T4 will now be described.

In the first interval T1, initialization is performed.

In the first interval T1, the previous scan signal is supplied to the previous scan line S[N−1], and the emission signal is supplied to the emission control line EM[N]. In other words, the previous scan signal and the emission signal are logic high in the first interval T1. The second, third, fifth, and seventh transistors M2, M3, M5, and M7 are turned on by the previous scan signal and the emission signal, and thus each node of the pixel circuit is initialized. In the first interval T1, the current scan signal applied to the current scan line S[N] is logic low.

In the second interval T2, the driving transistor M1 is diode-connected to compensate for the threshold voltage Vto of the OLED and the threshold voltage Vth of the driving transistor M1.

In the second interval T2, the previous scan signal is logic high, and the current scan signal and the emission signal are logic low. According to the previous scan signal, the second, fifth, and seventh transistors M2, M5, and M7 are turned on. Since the anode of the OLED is coupled to the fourth node N4 and the threshold voltage of the OLED is Vto, a voltage Vn4 of the fourth node N4 is ELVSS+Vto. Since the driving transistor M1 is diode-connected, a voltage Vn2 of the second node N2 is ELVSS+Vto+Vth. A voltage Vn3 of the third node N3 becomes the reference voltage Vref. Since the fifth node N5 is connected to the current scan line S[N] via the seventh transistor M7, a voltage Vn5 of the fifth node N5 is Vlow that is a voltage when a scan signal is logic low. The voltages of the second to fifth nodes N2 to N5 of the pixel circuit in the second interval T2 are summarized as follows.

N2: Vn2=ELVSS+Vto+Vth

N3: Vn3=Vref

N4: Vn4=ELVSS+Vto

N5: Vn5=Vlow

In the third interval T3, compensation for degradation of the OLED is performed, and data writing is performed.

In the third interval T3, the current scan signal is logic high, and the previous scan signal and the emission signal are logic low. When the fourth transistor M4 is turned on by the current scan signal, the data voltage Vdata is applied to the third node N3. When the sixth transistor M6 is turned on according to the current scan signal, the voltage of the anode of the OLED is applied to the fifth node N5. When the voltages Vn3 and Vn5 of the third and fifth nodes N3 and N5 are changed, the voltage Vn2 of the second node N2 is also changed due to couplings of the first and third capacitors C1 and Cis. In other words, the third capacitor Cis and the sixth transistor M6 serve as a booster capacitor and a booster transistor, respectively. A voltage variation of the voltage Vn2 depending on the voltage change of the third node N3 is ΔV1*{c1/(c1+cis)}, and a voltage variation of the voltage Vn2 depending on the voltage change of the fifth node N5 is ΔV2*{cis/(c1+cis)}. The voltages of the second to fifth nodes N2 to N5 of the pixel circuit in the third interval T3 are summarized as follows.

$$\begin{aligned} N2:\ Vn2 &= ELVSS + Vto + Vth + Vth + \Delta V1 * \\ &\quad \{c1/(c1+cis)\} + \Delta V2 * \{cis/(c1+cis)\} \\ &= ELVSS + Vto + Vth + (Vdata - Vref) * \\ &\quad \{c1/(c1+cis)\} + \\ &\quad (ELVSS + Vto - Vlow) * \{cis/(c1+cis)\} \end{aligned}$$

$$N3:\ Vn3 = Vdata\ (\Delta V1 = Vdata - Vref)$$

$$N4:\ Vn4 = ELVSS + Vto$$

$$N5:\ Vn5 = ELVSS + Vto\ (\Delta V2 = ELVSS + Vto - Vlow)$$

In the fourth interval T4, the OLED emits light due to current inflow.

In the fourth interval T4, the emission signal is logic high, and the previous scan signal and the current scan signal are logic low. The third transistor M3 is turned on by the emission signal. Since the third transistor M3 is turned on, a current flows through the OLED. When the OLED enters into an emission state due to the flow of the current therein, the voltage Vn4 of the fourth node N4, which is coupled to the anode of the OLED, is changed. When a voltage between the anode and cathode of the OLED during light emission is Voled, the voltage Vn4 is ELVSS+Voled. Since the fifth node N5 is in a floating state in the fourth interval T4, a voltage change at the anode of the OLED, which is coupled to the third node N3 via the second capacitor C2, leads to a voltage change of the second node N2. The voltages of the second and fourth nodes N2 and N4 of the pixel circuit in the fourth interval T4 are summarized based on this calculation, as follows.

$$\begin{aligned} N2:\ Vn2 &= ELVSS + Vto + Vth + (Vdata - Vref) * \{c1/(c1+cis)\} + \\ &\quad (ELVSS + Vto - Vlow) * \{cis/(c1+cis)\} + \Delta V3 \\ &= ELVSS + Vto + Vth + (Vdata - Vref) * \{c1/(c1+cis)\} + \\ &\quad (ELVSS + Vto - Vlow) * \{cis/(c1+cis)\} + (Voled - Vto) \end{aligned}$$

$$N4:\ Vn4 = ELVSS + Voled(\Delta V3 = Voled - Vto)$$

The voltage Vn2 of the second node N2 is the voltage of the gate electrode of the driving transistor M1, and the voltage Vn4 of the fourth node N4 is the voltage of the source electrode of the driving transistor M1. A condition of c1, c2>>cis is satisfied. Accordingly, $$Vg \approx ELVSS + Vto + Vth + Vdata - Vref + (ELVSS + Vto - Vlow) * (cis/c1) + Voled - Vto$$

$$Vs = ELVSS + Voled$$

A current I flowing through the OLED according to the voltages of the driving transistor M1 is calculated as follows:

$$\begin{aligned} I &= (\beta/2)(Vgs + Vth)^2 \\ &= (\beta/2)(Vg - Vs - Vth)^2 \\ &= (\beta/2)\{ELVSS + Vto + Vth + Vdata - Vref + \\ &\quad (ELVSS + Vto - Vlow) * (cis/c1) + \\ &\quad Voled - Vto - (ELVSS + Voled) - Vth\}^2 \\ &= \{\beta/2)\{Vdata - Vref + (ELVSS + Vto - Vlow)(cis/c1)\}^2, \end{aligned}$$

wherein β denotes a gain factor.

As the current I flows through the OLED, the threshold voltage Vto of the OLED is reflected in the current I. The threshold voltage Vto may vary according to the degradation of the OLED. Accordingly, the degradation of the OLED may be compensated for by appropriately controlling the capacitance cis of the third capacitor Cis.

As described above, in the pixel circuit and the pixel circuit driving method according to one embodiment, the threshold voltage Vto of the OLED may be reflected at the gate electrode of the driving transistor M1 by using the sixth transistor M6 and the third capacitor Cis. Accordingly, display performance of organic light emitting display devices may be prevented from degrading due to the degradation of the OLED.

Table 1 shows a result of a simulation performed on the pixel circuit of FIG. 1.

TABLE 1

| | Before degradation | After degradation |
|---|---|---|
| Vn5(V) | 4.5285 | 5.3812 |
| Vn2(V) | 1.1244 | 1.2103 |

As shown in Table 1, the voltage Vn5 increases as the OLED degrades, and the voltage Vn2 increases as the voltage Vn5 increases.

Table 2 shows a result of another simulation performed on the pixel circuit of FIG. 1.

TABLE 2

| | Vn2(V) | Vn4(V) | I(A) | ΔI(A) |
|---|---|---|---|---|
| Standard | 8.73 | 5.97 | 1.02E−06 | 0.00E+00 |
| Degradation 1 | 9.48 | 6.67 | 1.11E−06 | 9.44E−08 |
| Degradation 2 | 10.23 | 7.38 | 1.21E−06 | 1.86E−07 |

"Standard" denotes a case where no degradation of the OLED occurs, and "degradation 1" and "degradation 2" denote the cases where the OLED degrades. The degradation of the OLED is greater in the case of "degradation 2" than in the case of "degradation 1".

As shown in Table 2, as the voltage Vn4 increases, the voltage Vn2 increases accordingly. Accordingly, the current flow also increases.

Since luminous efficiency is lower in the cases where the OLED degrades than in the case where no degradation of the OLED occurs, the current flowing through the OLED needs to be increased so that a gray level having the same luminance as a gray level represented in the case where no degradation of the OLED occurs is represented in a degraded OLED. Accordingly, based on Table 1 and Table 2, the capacitance cis of the third capacitor Cis is controlled to adjust the voltage variation of the voltage Vn2. As a result, the current flowing through the OLED may be controlled.

Figure 3:
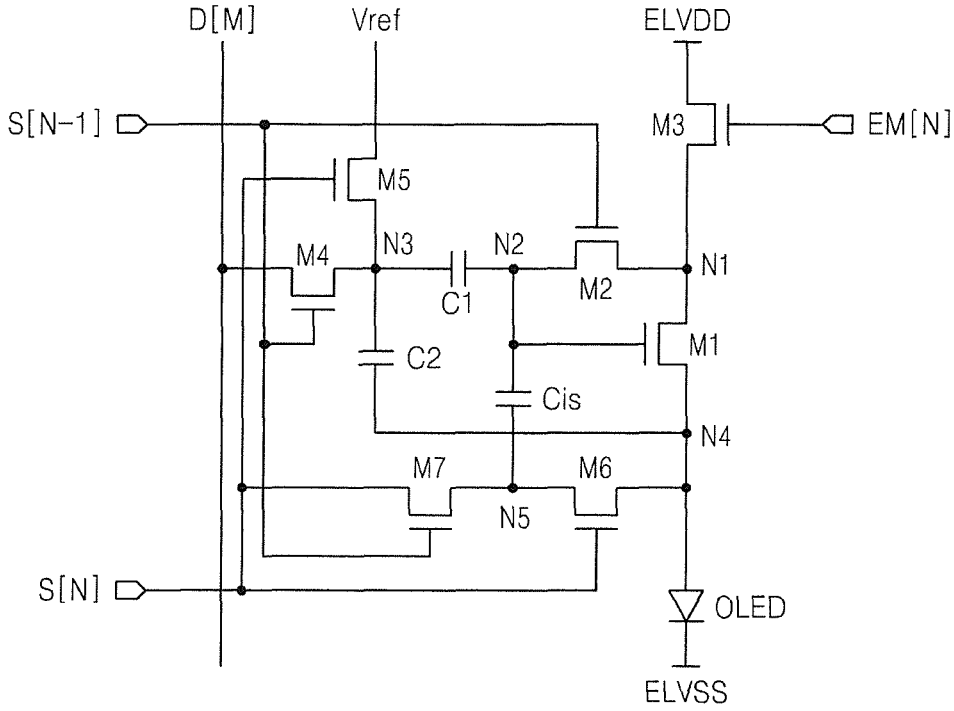
FIG. 3 is a circuit diagram of a pixel circuit of a display panel, according to another embodiment of the present invention.

FIG. 3 is a circuit diagram of a pixel circuit of a display panel according to another embodiment of the present invention.

Referring to FIG. 3, the pixel circuit according to one embodiment includes an OLED, first through seventh transistors M1 through M7, and first through third capacitors C1, C2 and Cis. The connections between these devices are the same as those of the pixel circuit of FIG. 1. Accordingly, descriptions of the same structure and operation as those of the pixel circuit of FIG. 1 will not be repeated, and the pixel circuit according to the embodiment shown in FIG. 3 will now be described by focusing on differences between the pixel circuits of FIGS. 3 and 1.

In the embodiment shown in FIG. 3, the previous scan signal is applied to the gate electrodes of the second, fourth, and seventh transistors M2, M4, and M7. Thus, the gate electrodes of the second, fourth, and seventh transistors M2, M4, and M7 are connected to the previous scan line S[N−1].

The current scan signal is applied to the gate electrodes of the fifth and sixth transistors M5 and M6. Accordingly, the gate electrodes of the fifth and sixth transistors M5 and M6 are connected to the current scan line S[N].

The emission signal is applied to the gate electrode of the third transistor M3. Accordingly, the gate electrode of the third transistor M3 is connected to the emission control line EM[N].

The first power source provides the first power supply voltage ELVDD, and the second power source provides a second power supply voltage ELVSS. The second power supply voltage ELVSS may be a ground voltage GND. The reference power source may provide a reference voltage Vref, which may be a logic high voltage.

The operations of the pixel circuits of FIGS. 1 and 3 are substantially the same, and the pixel circuits of FIGS. 1 and 3 operate according to the timing diagram of FIG. 2. However, in the embodiment shown in FIG. 3, the fourth transistor M4 is first turned on, and the fifth transistor M5 is then turned on, and thus a current I finally flowing through the OLED is calculated as follows:

$$I=(\beta/2)\{V\text{ref}-V\text{data}+(ELVSS+Vto-V\text{low})(cis/c1)\}^2.$$

Figure 4:
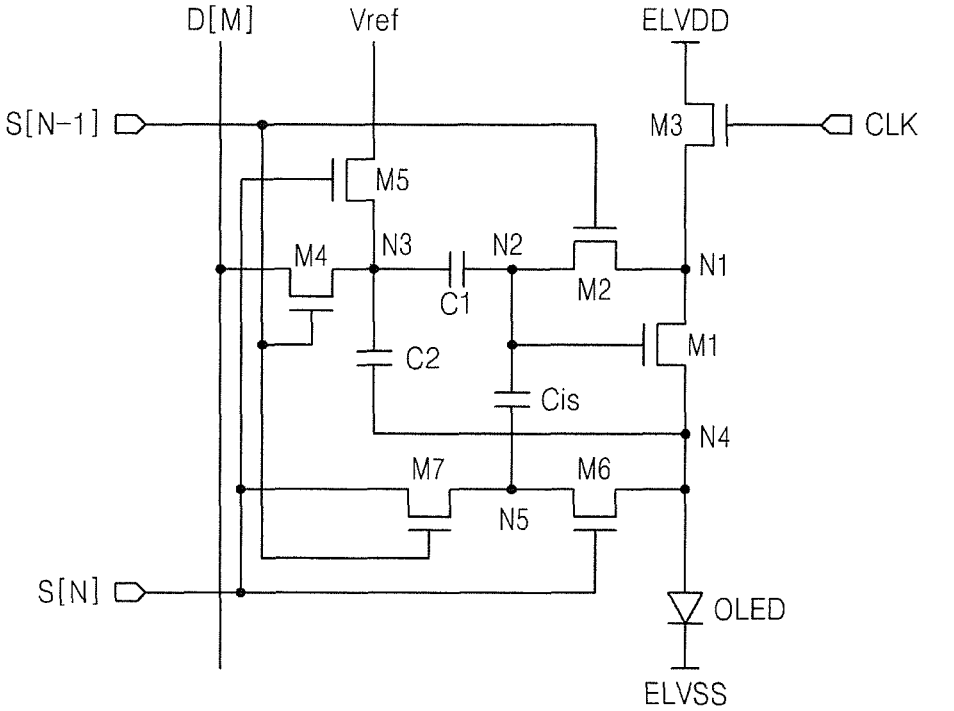
FIG. 4 is a circuit diagram of a pixel circuit of a display panel, according to another embodiment of the present invention.

FIG. 4 is a circuit diagram of a pixel circuit of a display panel according to another embodiment of the present invention.

Referring to FIG. 4, the pixel circuit according to the current embodiment includes an OLED, first through seventh transistors M1 through M7, and first through third capacitors C1, C2 and Cis. The connections between these devices are the same as those of the pixel circuit of FIG. 3. In the embodiment shown in FIG. 4, a clock signal CLK instead of the emission signal is applied to the gate electrode of the third transistor M3. The clock signal CLK may be generated from a system clock. In this case, a special driving unit for generating the emission signal is not needed.

Like the pixel circuit of FIG. 3, a current I flowing through the OLED of the pixel circuit of FIG. 4 is calculated as follows:

$$I=(\beta/2)\{V\text{ref}-V\text{data}+(ELVSS+Vto-V\text{low})(cis/c1)\}^2.$$

As described above, in the pixel circuit and the pixel circuit driving method according to the embodiment shown in FIG. 4, even if the types of signals applied to the second through seventh transistors M2 through M7 are changed, the threshold voltage Vto of the OLED may be reflected at the gate electrode of the driving transistor M1 by using the sixth transistor M6 and the third capacitor Cis. Accordingly, display performance of the display panel including the pixel circuit of FIG. 3 or FIG. 4 may be prevented from degrading due to the degradation of the OLED.

Figure 5:
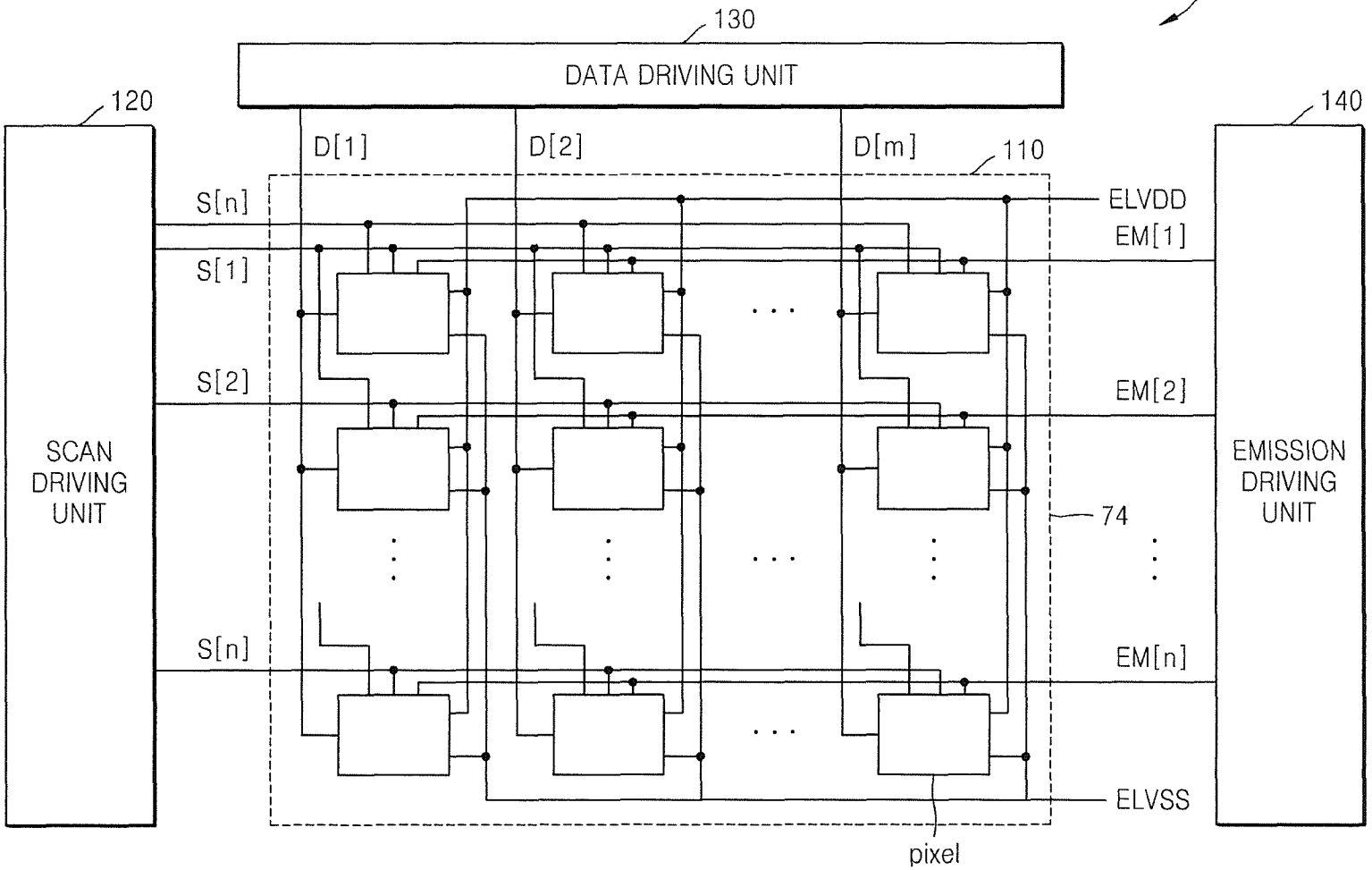
FIG. 5 is a block diagram of an organic light emitting display device according to an embodiment of the present invention.

FIG. 5 is a circuit diagram of an organic light emitting display device 100 according to an embodiment of the present invention.

Referring to FIG. 5, the organic light emitting display device 100 according to one embodiment includes a display panel 110, a scan driving unit 120, a data driving unit 130, and an emission driving unit 140.

The display panel 110 includes n×m pixels, n scan lines S[1] . . . S[n] arranged in rows, m data lines D[1] . . . D[m] arranged in columns, n emission control lines EM[1] . . . EM[n] arranged in rows, a first power supply voltage (ELVDD) application wire, and a second power supply voltage (ELVSS) application wire. Any of the pixel circuits of FIGS. 1, 3, and 4 may be formed in each of the pixels.

The scan lines S[1] . . . S[n] transmit scan signals to the pixels. The data lines D[1] . . . D[m] transmit data signals to the pixels.

The scan driving unit 120 supplies the scan signals to the scan lines S[1] . . . S[n]. The scan signals are sequentially applied to the scan lines S[1] . . . S[n], and the data signals are applied to the pixels in accordance with the scan signals.

The data driving unit 130 applies the data signals to the data lines D[1] . . . D[m]. The data signals may be output from a voltage source or a current source included in the data driving unit 130.

The emission driving unit 140 applies emission signals to the emission control lines EM[1] . . . EM[n].

Timings of the scan signals and the emission signals may be the same as those of the timing diagram of FIG. 2.

The pixels may be formed at crossing regions of the scan lines S[1] . . . S[n], the data lines D[1] . . . D[m], and the emission control lines EM[1] . . . EM[n].

As described above, the organic light emitting display device 100 according to one embodiment includes pixel circuits that can compensate for degradation of OLEDs, thereby preventing reduction of display performance.

A program for executing methods of driving the pixel circuits of the above-described embodiments and other embodiments may be stored in a storage media. The storage media may include magnetic storage media (e.g., ROMs, floppy disks, hard disk, and the like) and optical storage media (e.g., CD ROMS, DVDs and the like).

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A pixel circuit for a display panel comprising:

an organic light emitting diode (OLED) comprising an anode and a cathode;

a first NMOS transistor comprising a first electrode coupled to a first node, a second electrode coupled to the anode of the OLED, and a gate electrode coupled to a second node;

a second NMOS transistor comprising a first electrode coupled to the second node, a second electrode coupled to the first node, and a gate electrode;

a third NMOS transistor comprising a first electrode coupled to a first power source, a second electrode coupled to the first node, and a gate electrode;

a fourth NMOS transistor comprising a first electrode coupled to a data line, a second electrode coupled to a third node, and a gate electrode;

a fifth NMOS transistor comprising a first electrode coupled to a reference power source, a second electrode coupled to the third node, and a gate electrode;

a sixth NMOS transistor comprising a first electrode, a second electrode coupled to the anode of the OLED, and a gate electrode;

a seventh NMOS transistor comprising a first electrode, a second electrode coupled to the first electrode of the sixth NMOS transistor, and a gate electrode;

a first capacitor coupled between the second node and the third node;

a second capacitor coupled between the third node and the anode of the OLED; and a third capacitor coupled between the second node and the first electrode of the sixth NMOS transistor, wherein a current scan signal is applied to the gate electrode of the sixth NMOS transistor.

2. The pixel circuit of claim 1, wherein a previous scan signal is applied to the gate electrode of the second NMOS transistor and the gate electrode of the seventh NMOS transistor.

3. The pixel circuit of claim 1, wherein the current scan signal is applied to the first electrode of the seventh NMOS transistor.

4. The pixel circuit of claim 1, wherein an emission signal is applied to the gate electrode of the third NMOS transistor.

5. The pixel circuit of claim 1, wherein a clock signal is applied to the gate electrode of the third NMOS transistor.

6. The pixel circuit of claim 1, wherein a current scan signal is applied to the gate electrode of the fourth NMOS transistor and a previous scan signal is applied to the gate electrode of the fifth NMOS transistor.

7. The pixel circuit of claim 6, wherein the reference power source outputs a ground voltage.

8. The pixel circuit of claim 1, wherein a previous scan signal is applied to the gate electrode of the fourth NMOS transistor and a current scan signal is applied to the gate electrode of the fifth NMOS transistor.

9. The pixel circuit of claim 8, wherein the reference power source outputs a high level signal.

10. The pixel circuit of claim 1, wherein the first electrode of the first NMOS transistor comprises a drain electrode and the second electrode of the first NMOS transistor comprises a source electrode.

11. The pixel circuit of claim 1, wherein the capacitances of the first and second capacitors are greater than the capacitance of the third capacitor.

12. A method of driving a pixel circuit comprising an OLED, the OLED comprising an anode and a cathode, a driving transistor, a plurality of switching transistors, a booster transistor comprising a first electrode, a second electrode coupled to the anode of the OLED, and a gate electrode, a plurality of capacitors, and a booster capacitor coupled between the gate electrode of the driving transistor and the first electrode of the booster transistor, wherein the driving transistor, the plurality of switching transistors, and the booster transistor are NMOS transistors, the method comprising applying a previous scan signal, an emission signal, and a current scan signal to the pixel circuit, wherein, when the previous scan signal and the emission signal are logic low and the current scan signal is logic high, the booster transistor is turned on, and a voltage change at the first electrode of the booster transistor is transmitted to the gate electrode of the driving transistor due to coupling of the booster capacitor, and wherein the emission signal is different from any of the scan signals.

13. The method of claim 12, wherein the voltage change at the first electrode of the booster transistor comprises a change from a voltage at the first electrode of the booster transistor when the current scan signal is logic low to a threshold voltage of the OLED.

14. The method of claim 12, wherein, when the previous scan signal is logic high and the current scan signal and the emission signal are logic low, the driving transistor is diode-connected to compensate for the threshold voltage of the OLED.

15. The method of claim 12, wherein, when the previous scan signal and the current scan signal are logic low and the emission signal is logic high, a voltage change at the anode of the OLED is transmitted to the gate electrode of the driving transistor due to coupling of the plurality of capacitors.

16. An organic light emitting display device comprising:

a scan driver for providing scan signals to a plurality of scan lines;

an emission driver for providing emission signals to a plurality of emission control lines;

a data driver for providing data signals to a plurality of data lines; and a plurality of pixel circuits located at crossing regions of the scan lines, the emission control lines, and the data lines, wherein each of the pixel circuits comprises:

an organic light emitting diode (OLED) comprising an anode and a cathode;

a first NMOS transistor comprising a first electrode coupled to a first node, a second electrode coupled to the anode of the OLED, and a gate electrode coupled to a second node;

a second NMOS transistor comprising a first electrode coupled to the second node, a second electrode coupled to the first node, and a gate electrode coupled to an (N−1)th scan line;

a third NMOS transistor comprising a first electrode coupled to a first power source, a second electrode coupled to the first node, and a gate electrode;

a fourth NMOS transistor comprising a first electrode coupled to a data line, a second electrode coupled to a third node, and a gate electrode;

a fifth NMOS transistor comprising a first electrode coupled to a reference power source, a second electrode coupled to the third node, and a gate electrode;

a sixth NMOS transistor comprising a first electrode, a second electrode coupled to the anode of the OLED, and a gate electrode;

a seventh NMOS transistor comprising a first electrode, a second electrode coupled to the first electrode of the sixth NMOS transistor, and a gate electrode;

a first capacitor coupled between the second node and the third node;

a second capacitor coupled between the third node and the anode of the OLED; and a third capacitor coupled between the second node and the first electrode of the sixth NMOS transistor.

17. The organic light emitting display device of claim 16, wherein:

the gate electrode of the fifth NMOS transistor and the gate electrode of the seventh NMOS transistor are coupled to the (N−1)th scan line;

the gate electrode of the third NMOS transistor is coupled to an N-th emission control line; and the gate electrode of the fourth NMOS transistor, the gate electrode of the sixth NMOS transistor, and the first electrode of the seventh NMOS transistor are coupled to the N-th scan line.

18. The organic light emitting display device of claim 16, wherein:

the gate electrode of the second NMOS transistor, the gate electrode of the fourth NMOS transistor, and the gate electrode of the seventh NMOS transistor are coupled to an (N−1)th scan line;

the gate electrode of the third NMOS transistor is coupled to an N-th emission control line; and the gate electrode of the fifth NMOS transistor, the gate electrode of the sixth NMOS transistor, and the first electrode of the seventh NMOS transistor are coupled to an N-th scan line.

19. The organic light emitting display device of claim 16, wherein the first electrode of the first NMOS transistor comprises a drain electrode and the second electrode of the first NMOS transistor comprises a source electrode.

20. The organic light emitting display device of claim 16, wherein the capacitances of the first and second capacitors are greater than the capacitance of the third capacitor.

* * * * *